US009565725B2

(12) United States Patent
Arulandu et al.

(10) Patent No.: US 9,565,725 B2
(45) **Date of Patent: *Feb. 7, 2017**

(54) DRIVER DEVICE AND DRIVING METHOD FOR DRIVING A LOAD, IN PARTICULAR AN LED UNIT

(71) Applicant: PHILIPS LIGHTING HOLDING B.V., Eindhoven (NL)

(72) Inventors: Kumar Arulandu, Breda (NL); Harald Josef Günther Radermacher, Aachen (DE); Dmytro Viktorovych Malyna, Eindhoven (NL); Lucas Louis Marie Vogels, Herten (NL); Ralph Kurt, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 14/891,876

(22) PCT Filed: May 16, 2014

(86) PCT No.: PCT/EP2014/060032

§ 371 (c)(1),
(2) Date: Nov. 17, 2015

(87) PCT Pub. No.: WO2014/184326

PCT Pub. Date: Nov. 20, 2014

(65) Prior Publication Data

US 2016/0128142 A1 May 5, 2016

(30) Foreign Application Priority Data

May 17, 2013 (EP) ..... 13168249

(51) Int. Cl.
*H05B 33/08* (2006.01)

(52) U.S. Cl.
CPC ..... *H05B 33/0809* (2013.01); *H05B 33/0845* (2013.01)

(58) Field of Classification Search
CPC .... H02H 5/105; H02H 3/335; H05B 33/0815; H05B 33/0809; H05B 41/36
(Continued)

(56) References Cited

U.S. PATENT DOCUMENTS 6,873,111 B2 * 3/2005 Ito ..... B60Q 1/1407 315/273
8,212,491 B2 7/2012 Kost et al.
(Continued)

FOREIGN PATENT DOCUMENTS

EP 2373124 A1 10/2011
WO 2009121956 A1 10/2009
(Continued)

*Primary Examiner* — Douglas W Owens
*Assistant Examiner* — Wei Chan

(57) ABSTRACT

The present invention relates to a driver device for driving a load, in particular an LED unit having one or more LEDs, comprising input terminals for receiving an input voltage from an external power source for powering the load, and a connection unit for connecting the input terminals to each other and for providing a current path for a bleeding current, wherein the connection unit comprises a first current path for connecting the input terminals in a first current direction and a second current path for connecting the input terminals in a second current direction opposite to the first current direction, wherein the connection unit comprises a first current control unit for controlling the bleeding current in the connection unit, and wherein the first and the second current path each comprises a second current control unit for controlling the bleeding current in the respective current path.

15 Claims, 5 Drawing Sheets

(58) Field of Classification Search
USPC ..... 315/200 R, 185 R, 182, 411, 135–136, 315/279, 224
See application file for complete search history.

(56) References Cited

U.S. PATENT DOCUMENTS

| | | | | |
|---|---|---|---|---|
| 2009/0251059 | A1* | 10/2009 | Veltman ..... | H05B 33/0815 315/200 R |
| 2012/0056553 | A1 | 3/2012 | Koolen et al. | |
| 2012/0126714 | A1 | 5/2012 | Deppe et al. | |
| 2012/0242252 | A1 | 9/2012 | Yang et al. | |

FOREIGN PATENT DOCUMENTS

| | | | |
|---|---|---|---|
| WO | 2011045371 | A1 | 4/2011 |
| WO | 2013035045 | A1 | 3/2013 |
| WO | 2013064960 | A1 | 5/2013 |
| WO | 2013102853 | A1 | 7/2013 |

* cited by examiner

DRIVER DEVICE AND DRIVING METHOD FOR DRIVING A LOAD, IN PARTICULAR AN LED UNIT

CROSS-REFERENCE TO PRIOR APPLICATIONS

This application is the U.S. National Phase application under 35 U.S.C. §371 of International Application No. PCT/EP2014/060032, filed on May 16, 2014, which claims the benefit of European Patent Application No. 13168249.4, filed on May 17, 2013. These applications are hereby incorporated by reference herein.

FIELD OF THE INVENTION

The present invention relates to a driver device and a corresponding driving method for driving a load, in particular an LED unit comprising one or more LEDs. Further, the present invention relates to a light apparatus.

BACKGROUND OF THE INVENTION

In the field of LED drivers for offline applications such as retrofit lamps, solutions are demanded to cope with high efficiency, high power density, long lifetime, high power factor and low costs among other relevant features. While practically all existing solutions comprise one or the other requirement, it is essential that the proposed driver circuits properly condition the form of a mains energy into the form required by the LEDs while complying with present and preferably future power mains regulations. In addition, it is required that the driver circuits compatible with existing and legacy power adjustment means, e.g. dimmers or the like, so that the drivers can be used universally as a retrofit driver device including the LED units.

The driver circuits should comply with all kinds of dimmers and especially the drivers should comply with phase-cut dimmers, which are preferably used to regulate the mains powers with low power loss. Those dimmers which were initially designed to regulate the mains energy provided to a filament lamp utilized the low load impedance path of the filament for a timing circuit operation current to adjust the phase-cut timing. Alternatively to providing this path continuously, connecting and disconnecting this path for a certain part of the mains voltage cycle can also result in a stable operation of the dimmer. The provision of this low impedance path has to be adjusted with respect to the zero crossing of the mains voltage. To achieve timely provision of this low impedance path, the zero crossing is usually detected by the driver circuit of the lamps while it is in a high impedance state. Such a zero crossing detection is complicated and has a high technical effort and if a large amount of LED units is connected to one dimmer circuit, the technical effort increases due to the required increase of impedance of each individual LED unit.

WO 2009/121956 A1 discloses a lighting apparatus comprising an LED assembly and a rectifier unit to connect the LED unit to a dimmer circuit. The LED unit comprises a bleeder connected in parallel to the LED unit to provide a bleeding current. The bleeder unit is controlled by a control unit connected to the LEDs to provide a bleeding current at a certain point in time of the rectified AC voltage. This control unit is complicated and the power factor of the whole lighting apparatus is reduced due to the bleeding current.

US 2012/0056553 A1 discloses a driver device for connecting an LED unit to a dimmer device, wherein two parallel bleeding paths are provided comprising different resistance values in order to adjust the rectified input voltage in different parts of the main voltage cycle differently. Since the two bleeding paths are both adapted to be connected to the mains voltage, high voltage components are necessary and since the phase of the mains voltage has to be determined, this bleeding circuit is technically complicated and requires an increased amount of large components such that an integration of these components is not possible.

SUMMARY OF THE INVENTION

It is an object of the present invention to provide a driver device and a corresponding driving method for driving a load, in particular an LED unit comprising one or more LEDs providing compatibility to different dimmer devices, in particular to phase-cut dimmers, with low technical effort and a reduced size. Further, it is an object of the present invention to provide a corresponding light apparatus.

According to one aspect of the present invention a driver device for driving a load, in particular an LED unit comprising one or more LEDs is provided comprising:

- input terminals for receiving an input voltage from an external power source for powering the load, and
- a connection unit for connecting the input terminals to each other and for providing a current path for a bleeding current, wherein the connection unit comprises a first current path for connecting the input terminals in a first current direction and a second current path for connecting the input terminals in a second current direction opposite to the first current direction, wherein the connection unit comprises a first current control unit for controlling the bleeding current in the connection unit, and wherein the first and the second current path each comprises a second current control unit for controlling the bleeding current in the respective current path.

According to another aspect of the present invention, a driving method for driving a load, in particular an LED unit comprising one or more LEDs is provided, wherein the driving method comprises the steps of:

- receiving an input voltage from an external power supply at input terminals, connecting the input terminals to each other by means of a connection unit providing a first current path for a bleeding current in a current direction from a first of the input terminals to a second of the input terminals and a second current path for the bleeding current in a current direction from the second to the first input terminal,
- controlling the bleeding current in the connection unit by means of a first current control unit, and
- controlling the bleeding current in each of the current paths by means of a second current control unit.

According to still another aspect of the present invention a light apparatus is provided comprises a light assembly comprising one or more light units, in particular an LED unit comprising one or more LEDs, and a driver device for driving a light assembly as provided according to the present invention.

Preferred embodiments of the invention are defined in the dependent claims. It shall be understood that the claimed method has similar and identical preferred embodiments as the claimed device and as defined in the dependent claims.

The present invention is based on the idea to provide a driver device having a high impedance and a low impedance path, wherein a switching from the high impedance path to the low impedance path is synchronized to the cycle of the power supply, in particular to the mains voltage. The low impedance path is provided after zero crossing of the mains voltage. The zero crossing is not detected actively, but two different low impedance paths are provided for the different current directions and can be activated by means of the second current control units. Hence, the different current paths can be activated prior to the zero crossing, wherein the bleeding current is due to the directional characteristic of the respective current path enabled after the polarity change of the input voltage. Hence, a bleeding current including a zero crossing detection can be provided with low technical effort. Further, the first current control unit is provided in order to block the bleeding current and to protect the second current control units from the high input voltage such that the technical effort of the second current control units and the size of the second control units can be reduced. Therefore, the technical effort of the whole driver device can be reduced and the second current control units can be integrated in an integrated circuit.

In a preferred embodiment, the connection unit comprises a plurality of decoupling devices, wherein one decoupling device is associated to each of the current paths for blocking the bleeding current in the respective current path in a current direction opposite to the current direction for which the respective current path is provided. This is a simple solution to provide directional current paths and to provide the necessary zero crossing detection with low technical effort.

In a further preferred embodiment, a control unit is provided for controlling the second control units on the basis of a voltage potential detected at the respective current path. This is a solution to synchronize the bleeding paths to the polarity of the input voltage with low technical effort.

In a further preferred embodiment, the first current control unit is connected in series to each of the current paths, wherein the current paths are connected in parallel to each other. Therefore, the first current control unit can enable and disable the whole connection unit and can protect the second control units from high voltages so that the second current control units can be provided with low technical effort and may be integrated in an integrated circuit.

According to a further preferred embodiment, the driver device comprises a rectifier unit for rectifying the input voltage and for providing a rectified voltage to the load for driving the load, wherein the first current control unit is connected to a first output node of the rectifier unit and the second control units are each connected to two decoupling devices of the rectifier unit. This is a possibility to provide directional current paths with low technical effort, since the connection unit is integrated in the rectifier unit so that the decoupling devices of the rectifier unit can be used also for the directional current paths.

In a further preferred embodiment, decoupling devices are connected between the second current control units and a second output node of the rectifier unit and are adjusted in a reverse direction for blocking the bleeding current. This is a possibility to conduct the bleeding current to the input terminals with low technical effort.

In a further preferred embodiment, two decoupling devices are each connected in series between the second output node and one of the input terminals. This is a possibility to utilize parts of the rectifier unit to provide the directional current paths and to integrate the connecting unit in the rectifier unit with low technical effort.

In a further preferred embodiment, a third current path comprising a further second current control unit is connected between the first current control unit and the second output node of the rectifier unit. This is a possibility to provide an additional polarity independent current path having an impedance different from the two directional current paths.

In a further preferred embodiment, the first control unit is provided for enabling and/or controlling and/or limiting the bleeding current in the connection unit and the second control units are controllable switches for enabling the bleeding current in the respective current path. This is a solution to enable the bleeding current quickly with a high switching time and low technical effort.

According to a further preferred embodiment, the first current control unit and the second current control units are connected to each other such that the first current control unit is activated for enabling the bleeding current if one of the second current control units is activated and the polarity of the input voltage changes. This is a possibility to protect the second current control units from the high input voltage so that the second current control units can be adapted for low voltages, since the bleeding current is only enabled if the bleeding path is entirely connected through.

In a further preferred embodiment, the second control units each comprises two controllable switches, wherein a first of the two controllable switches is adapted to conduct the bleeding current and is controlled by a second of the two controllable switches. This is a possibility to reduce the leakage current of the second current control units while having an identical switching behavior of the respective controllable switch assembly due to the second controllable switch controlling the first controllable switch.

In a further preferred embodiment, the control unit is adapted to activate one of the second current control units during a first half cycle of the input voltage and to deactivate the respective current control unit during a following half cycle of the input voltage. Due to the directional current paths, which provide a bleeding current only in one current direction, the zero crossing of the input voltage can be easily detected since the bleeding current starts when the polarity of the input voltage changes. Hence, the control unit can be provided with low technical effort since a precise switching of the second control units is not necessary.

In a further preferred embodiment, the control unit is adapted to control the current control units on the basis of a phase angle of the input voltage detected by a phase angle detection device. This is a possibility to disable the connection device when the phase cut of the input voltage is detected and the dimmer device provides the input voltage to the mains voltage so that the timing of the bleeding current can be optimized.

In a further preferred embodiment, the first current control unit is a high voltage bipolar transistor and the second current control units are low voltage bipolar transistors, wherein the base of the first bipolar transistor is biased by means of an auxiliary voltage supply. This is a possibility to control the first bipolar transistor by means of the second bipolar transistors, since the collector-emitter-path of the biased transistor can be activated by controlling the emitter voltage which corresponds to the collector voltage of the second bipolar transistors. Hence, the first current control unit can be easily controlled by the second current control unit in order to protect the second control units from high voltages of the external voltage supply.

As mentioned above, the present invention provides a low impedance current path dependent on the polarity of the input voltage with low technical effort, wherein the low impedance current path is enabled after the zero crossing of the input voltage to provide a driver device which is compatible with a phase-cut dimmer for a retrofit LED lamp. By activating the respective current paths by means of the second current control units depending on the polarity of the input voltage, each path is prepared while the decoupling element, in particular the diode, is still blocking the respective path and activates the path after zero crossing and the respective polarity change of the input voltage. Since the additional first current control unit is provided in the connection unit, the second current control units in the directional current paths can be protected from the high input voltage so that the second current control units can be provided with low technical effort and in particular integrated in an integrated circuit for reducing the overall size of the driver device.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
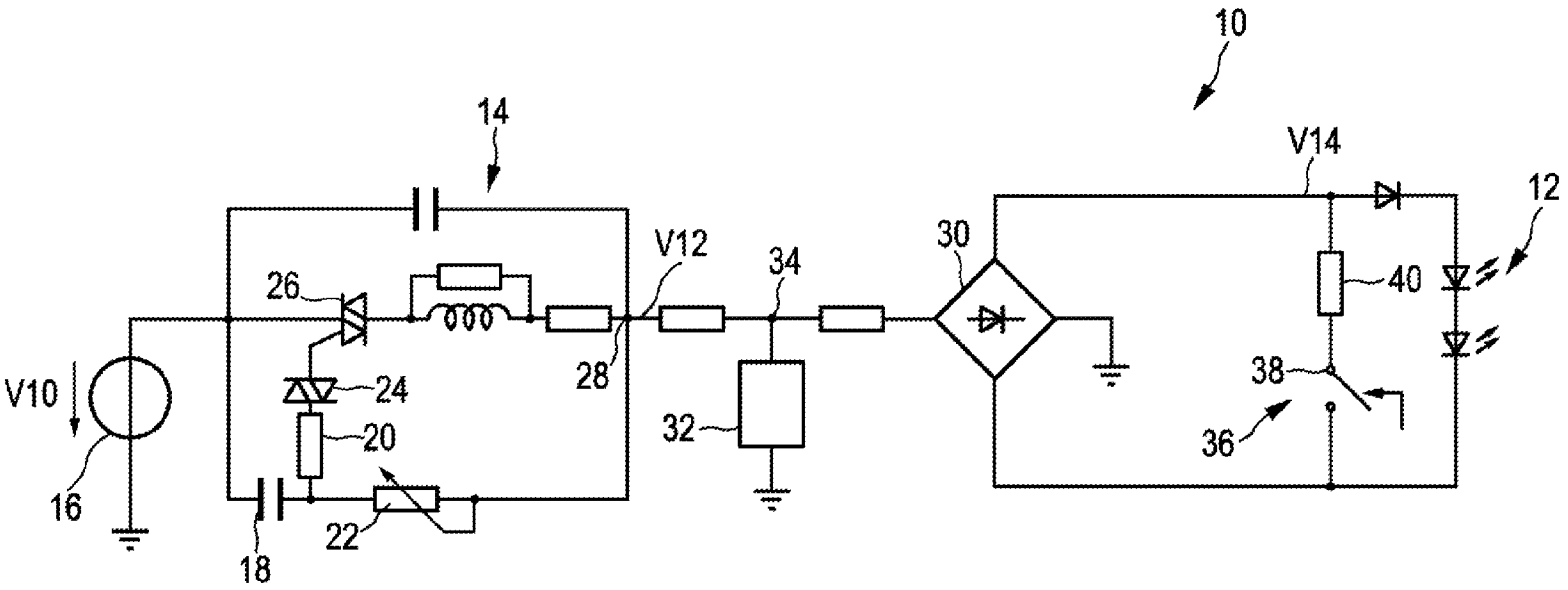
FIG. 1 (Prior Art)
FIG. 1 shows a schematic block diagram of a known driver device for connecting an LED unit to a phase-cut dimmer including zero crossing detection.

FIG. 1 shows an embodiment of a known driver device 10 for driving an LED unit 12 and for connecting the LED unit 12 via a dimmer device 14 to an external power supply 16 such as mains. The external power supply 16 provides an alternating voltage V10 (e.g. mains voltage) to the dimmer device 14. The dimmer device 14 is a phase-cut dimmer comprising a capacitor 18 and an adjustable resistor 22 for determining a point in time where the dimmer device 14 connects its output to the mains voltage V10. Resistor 22 can be adjusted to set the phase angle provided by the dimmer device 14. The RC circuit formed of the capacitor 18 and the resistors 20 is connected to a first switching device 24 such as a DIAC, which is connected to a second switching device 26 such as a TRIAC. The second switching device 26 is connected to the external power supply 16 and connects the voltage V10 to the output of the dimmer device 14. When the voltage across a capacitor 18 reaches a break over value of switch 24, the first switching device 24 conducts a current pulse to the second switching device 26 which connects the external power supply 16 with the output of the dimmer device and provides the voltage V10 to the driver device 10. Hence, the dimmer device 14 cuts the phase of the voltage V10 and provides a phase-cut voltage at its output terminal 28, which serves as an input voltage V12 for the driver device 10.

The driver device 10 comprises a rectifier unit 30 for rectifying the input voltage V12 to a unit polar voltage V14. The driver device 10 further comprises a voltage measurement unit 32 connected to an input terminal 34 of the driver device 10 for detecting a zero crossing of the input voltage V12. The driver device 10 further comprises a bleeder device 36 including a controllable switch 38 and a resistor 40. The bleeder device 36 provides a current path for the rectifier unit 30 by switching the controllable switch 38, wherein the bleeder device 36 is activated by zero crossing and phase-cut detection detected by the voltage measurement unit 32, which controls the controllable switch 38 via a control signal. Hence, the bleeder device 36 can be activated or deactivated for certain periods of time by means of the voltage measurement unit 32.

Hence, the driver device 10 detects the zero crossing of the input voltage V12 and activates the bleeder device 36 by means of the controllable switch 38 to provide a bleeding current and a continuous current path to the dimmer device 14.

Generally, the driver device 10 complies with the dimmer device 14 by providing a partially time-continuous current path through the driver device 10 to the dimmer device 14, however, the zero crossing of the voltage V12 has to be measured by means of the voltage measurement unit 32, which limits the realizable impedance in the high impedance state. In especially if a plurality of driver devices are connected to the dimmer 14, each of the voltage measurement units 32 in each driver device, loads the dimmer and hence reduces the total impedance in an unwanted way. To compensate this, each voltage measurement unit 32 has to be provided with a very large input impedance. Hence, this known driver device 10 is technically complex and expensive to produce a retrofit LED lamp.

Figure 2:
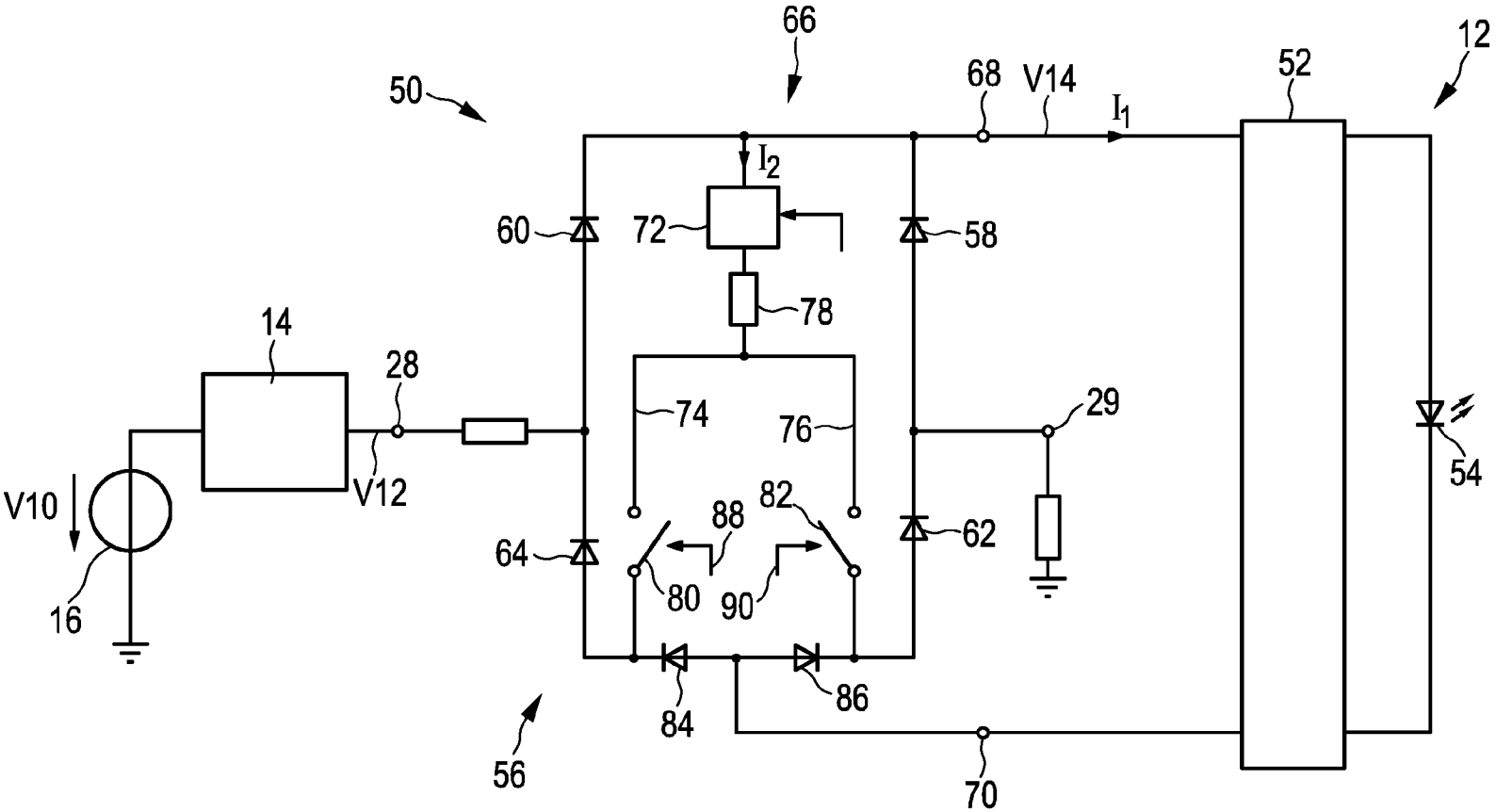
FIG. 2 shows a schematic block diagram of an embodiment of a polarity dependent bleeder.

FIG. 2 shows a schematic block diagram of an embodiment of the present invention. Identical elements are denoted by identical reference numerals, wherein here just the differences to the diagram shown in FIG. 1 are explained in detail.

A driver device 50 is connected to the output terminal 28 of the dimmer device 14 in order to receive the phase-cut voltage as the input voltage V12. The input terminal of the dimmer device 14 is connected to mains 16 and a node 29 is connected to the neutral or ground potential of the mains 16. The driver device 50 is connected to the LED unit 12, which comprises an LED driver 52 and an LED 54.

The driver device 50 provides a load current I1 to the load 12 for driving the load 12. The driver device 50 comprises a rectifier unit 56 connected to the output terminals 28, 29 of the dimmer device 14 for rectifying the input voltage V12 to provide a rectified unipolar voltage V14 and the unipolar load current I1 for driving the load 12. The rectifier unit 56 comprises a plurality of diodes 58, 60, 62, 64 for rectifying the input voltage V12 and for providing the rectified voltage V14 to the load 12. The driver device 50 further comprises a connection unit 66 or a polarity dependent bleeder 66 connected to the rectifier unit 56 in order to enable a bleeding path as described in the following. The polarity dependent bleeder 66 enables a current path between the input terminal 28 and the node 29 and based upon the polarity, the impedance will appear high or low for the dimmer device 14 by enabling and disabling a bleeding current I2. The rectifying unit 56 comprises a first output terminal 68 and a second output terminal 70 for connecting the rectifier unit 56 to the LED driver 52.

The polarity dependent bleeder 66 is connected to the rectifier unit 56 in order to provide a low impedance path for connecting the input terminal 28 and the node 29 to each other and for enabling a bleeding current I2 for zero crossing detection after the hold state of the LED driver 52. The polarity dependent bleeder 66 comprises a first current control unit 72 connected to the first output terminal 68 and two polarity dependent bleeding paths 74, 76 which are each connected via a resistor 78 to the first current control unit 72. The polarity dependent bleeding paths 74, 76 each comprises one second current control unit 80, 82 which are preferably formed as a controllable switch 80, 82 in order to activate the respective polarity dependent bleeding path 74, 76 and to enable the bleeding current I2. The second current control units 80, 82 of the two polarity dependent bleeding paths 74, 76 are each connected to a diode 84, 86 which are connected to the second output terminal 70. The second current controllable units 80, 82 are each connected to the input terminals 28, 29 via one of the diodes 62, 64 of the rectifier unit 56, respectively. The diodes 84, 86 are each adjusted in a reverse direction so that the bleeding current I2 is blocked in a direction to the second output terminal 70. The diodes 62, 64 are directed in a forward direction so that the bleeding current I2 can be provided from the polarity dependent bleeder 66 to each of the input terminals 28, 29, respectively.

The second current control units 80, 82 are each controlled by a control signal 88, 90 on the basis of a voltage potential measured between the diodes 64 and 84 or 62 and 86, respectively. The first current control unit 72 is preferably a controllable switch or a controllable resistor which may be controlled by a control signal. The first current control unit 72 connects and disconnects the polarity dependent bleeding paths 74, 76 to the respective input terminal 28, 29 and therefore to the input voltage V12. The first current control unit 72 is designed for a high voltage, e.g. mains voltage, and provided to protect the second current control units 80, 82 and the diodes 84 and 86 against the input voltage V12. Hence, the second current control units 80, 82 and the diodes 84 and 86 can be designed for low voltages.

The diodes 64, 84 which are associated to the polarity dependent bleeding path 74 and the diodes 62, 86 which are associated to the polarity dependent bleeding paths 76 enable the bleeding current I2 only for one polarity of the input voltage V12. Hence, the bleeding current I2 is only enabled if the respective controllable switch 80, 82 is closed and the input voltage V12 has the respective polarity.

During the operation of the driver device 50, one of the second current control units 80, 82 are activated during a first half wave of the alternating input voltage V12 so that the respectively associated diodes 64, 84 and 62, 86 are blocking the bleeding current I2. Shortly after a polarity change which indicates a zero crossing of the input voltage V12, the respective diode 64, 62 starts to conduct and pre-enables the respective current path 74, 76 and the first current control unit 72 is activated. Hence, the so provided low impedance path of the polarity dependent bleeder 66 enables the bleeding current I2 and applies a load current or an impedance between the input terminal 28 and the node 29. After a cutting phase of the input voltage V12 is detected, the respective second current control unit 80, 82 and the first current control unit 72 are deactivated. Load current I1 can be provided to the load 12 for powering the load. Hence, the bleeding current I2 is enabled after the zero crossing of the input voltage V12 in order to provide a low impedance path for the dimmer timing circuit which is required by the dimmer device 14 to work properly.

Since the first current control unit 72 is activated only after the zero crossing is detected, the second current control units 80, 82 and the associated diodes, 84, 86 are protected and can be designed as low voltage devices.

Figure 3:
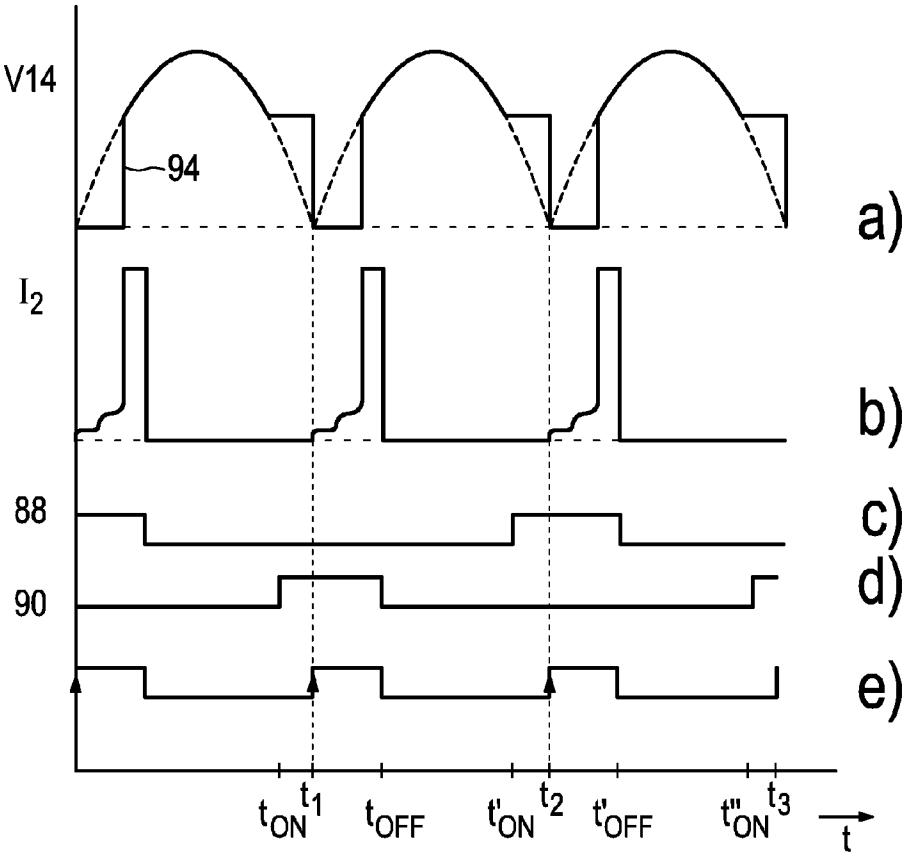
FIG. 3 shows schematic timing diagrams of the rectified voltage and the bleeding current of the driver device and the control signals for controlling the polarity dependent bleeding paths.

FIG. 3 shows a timing diagram of the rectified voltage V14, the bleeding current I2, the control signals 88, 90 and the zero crossing detection for three half waves of the input voltage V12.

FIG. 3*a* shows the rectified voltage V14 as a rectified voltage of the input voltage V12. The rectified voltage V14 comprises a leading edge 94 provided by the dimmer device 14 as mentioned above wherein the rectified voltage V14 rapidly increases at the leading edge 94. The rectified voltage V14 is equal to zero at $t_1$, $t_2$ and $t_3$ corresponding to a zero crossing or a polarity change of the input voltage V12 or the mains voltage V10.

FIGS. 3*c* and *d* show the control signals 88, 90 corresponding to the activation time of the respective second current control unit 80, 82. The function of the polarity dependent bleeder 66 is as an example described on the basis of the control signal 90 driving the controllable switch 82. The controllable switch 82 is closed at $t_{on}$ prior to the zero crossing $t_1$, wherein the bleeding current I2 remains zero since the diodes 62 and 86 block the bleeding current I2 for this polarity direction of the input voltage V12. After the input voltage V12 is equal to zero or the polarity of the input voltage V12 has changed at $t_1$, the diode 62 conducts and the first current control unit 72 activates the polarity dependent bleeder 66. After the zero crossing at $t_1$, the bleeding current I2 slowly increases until the leading edge 94 is reached. When the leading edge 94 is reached, the bleeding current I2 rapidly increases due to the rapidly rising rectified voltage V14. At $t_{off}$, the controllable switch 82 is opened and the first current control unit 72 disconnects the polarity dependent bleeder 66 so that the bleeding current I2 is rapidly reduced to zero.

Hence, the respective polarity dependent bleeding paths 74, 76 are activated at $t_{on}$ prior to the zero crossing at $t_1$ while the diodes 62, 86 are blocking the bleeding current I2 and the bleeding current I2 is enabled and rising after the zero crossing of the input voltage V12 at $t_1$. At $t_{off}$, the controllable switch 82 is opened and the first current control unit 72 disconnects the polarity dependent bleeder 66 accordingly in order to protect the low voltage controllable switch 82 from the input voltage V12. Therefore, the polarity dependent bleeder 66 can automatically detect the zero crossing and automatically enable the bleeding current I2 as desired.

Figure 4:
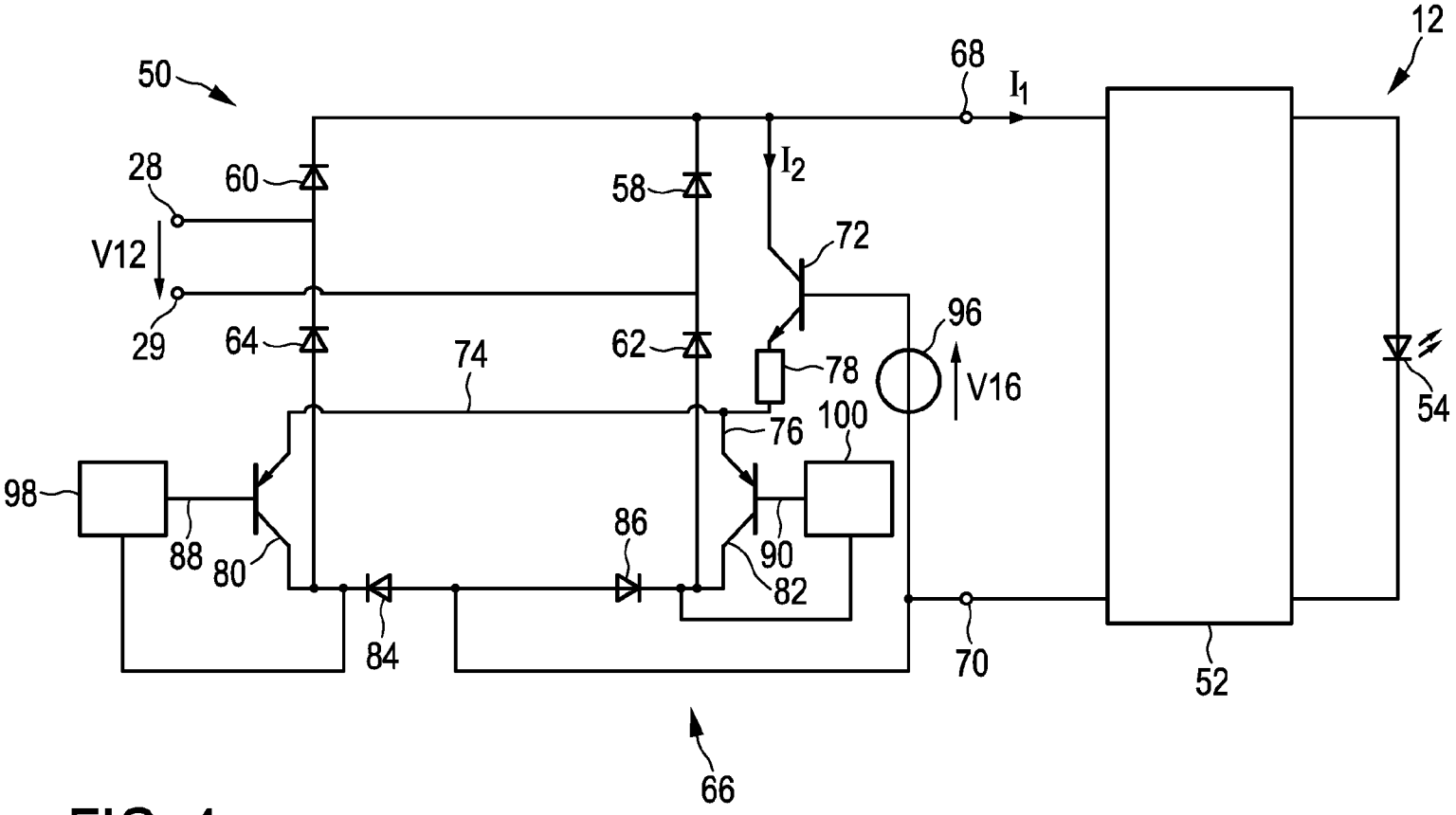
FIG. 4 shows a detailed block diagram of a further embodiment of the polarity dependent bleeder.

FIG. 4 shows a schematic block diagram of a further embodiment of the driver device 50. Identical elements are denoted by identical reference numerals, wherein here merely the differences are explained in detail.

The first current control unit 72 is formed as a bipolar transistor, wherein the collector is connected to the first output terminal 68 of the rectifier unit 56 wherein the emitter is connected via the resistor 78 to the two polarity dependent bleeding paths 74, 76. The base of the bipolar transistor 72 is connected to an auxiliary voltage source 96 which provides a constant auxiliary voltage V16 in order to provide a constant bias voltage to the base. The auxiliary voltage source 96 is further connected to the second output terminal 70 as a reference potential.

The two second current control units 80, 82 are each formed as a bipolar transistor, wherein each of the emitters are connected via the resistor 78 to the first bipolar transistor 72 and each of the collectors are connected to the rectifier unit 56 between the diodes 64 and 84 or 62 and 86, respectively. The second bipolar transistors 80, 82 are each connected to a control unit 98, 100 which provide the respective control signal 88, 92 in order to switch the second bipolar transistors 80, 82 and to activate the respective polarity dependent bleeding paths 74, 76, respectively. The control units 98, 100 are connected to the base and the collector of the respective second bipolar transistor 80, 82 respectively in order to control the second bipolar transistors 80, 82 on the basis of the voltage potential at the rectifier unit 56, in particular on the basis of the voltage potential at the respective diode 62, 64.

A third bleeding path may be provided in parallel to the polarity dependent bleeding paths 74, 76 in order to connect the resistor 78 to the second output terminal 70 directly.

During the operation of the driver device 50 the LED driver 52 will go into a disconnection phase and will form a high impedance path. However, after the following zero crossing of the input voltage V12, a low impedance path has to be provided by the driver device 50 in order to assure a proper function of the dimmer device 14. During a half cycle of the input voltage V12 when the diodes 60, 62 and 86 are conducting or forward biased, the bipolar transistor 80 is switched on at $t_{on}$ while the bipolar transistor 82 is still switched off. During this phase, the bleeding current I2 is zero since the diodes 64 and 84 are blocking or reverse biased. The voltage at the collector of the bipolar transistor 80 and emitter voltage of the bipolar transistor 80 is almost equal to the auxiliary voltage V16 so that the base-emitter voltage of the bipolar transistor 72 is almost zero and the bipolar transistor 72 is blocking or not conductive. Hence, the bipolar transistor 72 which is a high voltage device protects the low voltage bipolar transistors 80, 82 and the respective diodes from the input voltage V12. Shortly after zero crossing at $t_1$, the diode 64 starts to conduct or is forward biased. The emitter voltage of the bipolar transistor 80 will drop so that the emitter voltage of the bipolar transistor 72 will also drop. Since the bipolar transistor 72 is biased by the auxiliary voltage V16, the bipolar transistor 72 will start to conduct and enables the bleeding current I2. Hence, the polarity dependent bleeder 66 provides a low impedance path and enables the bleeding current I2 immediately after the zero crossing of the mains voltage V10. Since the first current control unit 72 is a high voltage device and conducts only if one of the low voltage second current control units 80, 82 are conductive, the first current control unit 72 can protect the second current control units 80, 82 from the high voltages. In other words, the first bipolar resistor 72 is controlled via the emitter by means of the second bipolar transistors 80, 82. The bipolar transistor 80 is switched off at $t_{off}$ after the bleeding current I2 increases after the leading edge 94 in order to provide the load current I1 for powering the load 12.

The bipolar transistor 82 will be switched on after the bipolar transistor 80 is switched off and provides the bleeding current I2 immediately after the following zero crossing of the input voltage V12.

Hence, the first current control unit 72 which is formed as the bipolar transistor 72 is controlled via the emitter by means of the second control units 80, 82 or the diodes 64, 62, respectively, since the base of the bipolar transistor 72 is biased by the auxiliary voltage V16, which is typically between 5 and 12 Volt.

Since the second control units 80, 82 are protected from the high voltage and can be designed as low voltage devices, the second control units 80, 82 can be integrated in an integrated circuit in order to save costs and space.

Figure 5:
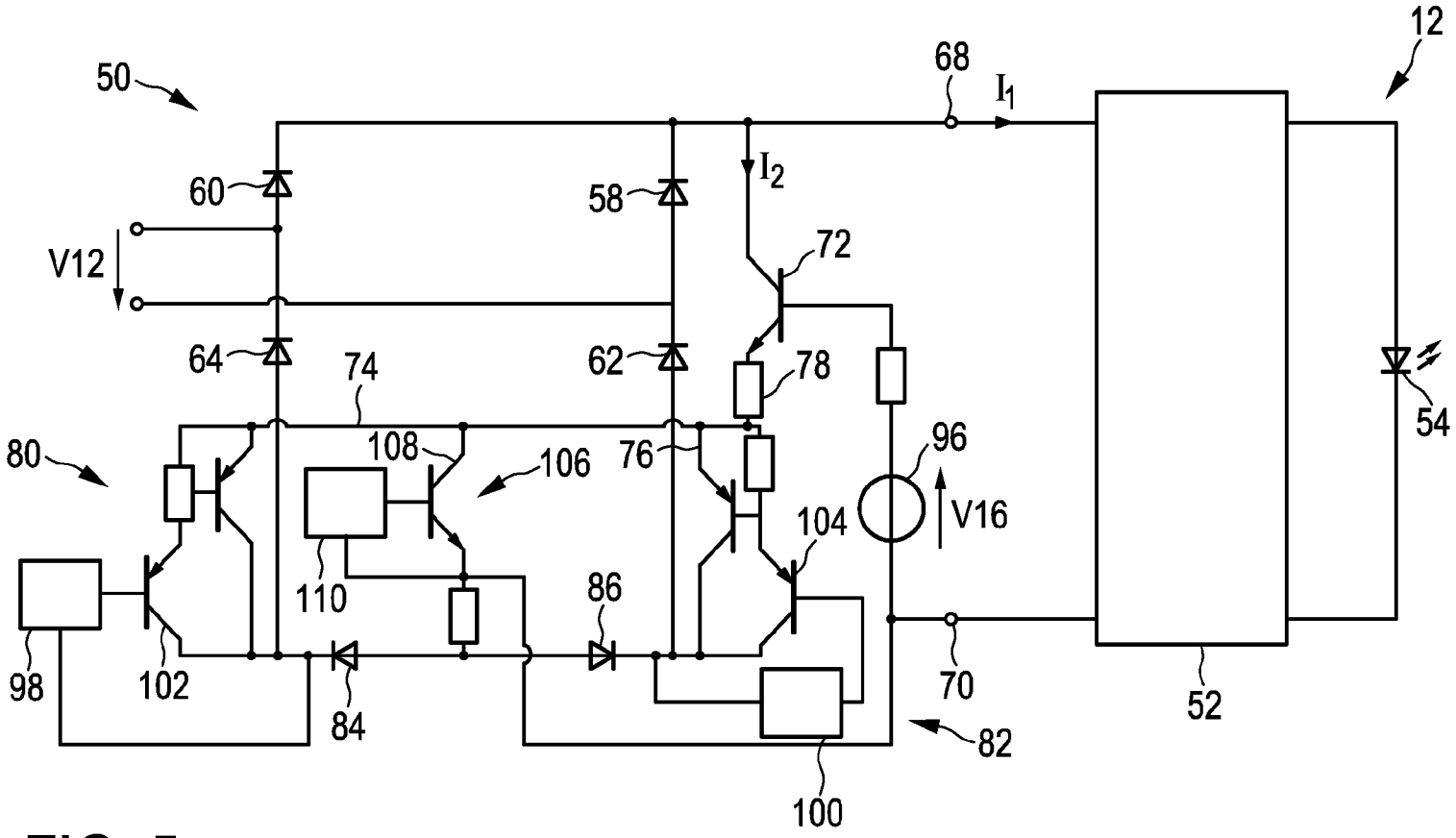
FIG. 5 shows a schematic block diagram of a further embodiment of the polarity dependent bleeder having a reduced leakage current.

FIG. 5 shows a further embodiment of the driver device 50 having a reduced leakage current. Identical elements are denoted by identical reference numerals, wherein here merely the differences are explained in detail.

The second control units 80, 82 formed as a bipolar transistor 80, 82 have a leakage current during the blocking phase whereby the timer of the phase-cut dimmer 14 may be affected. The leakage current strongly depends on the current gain of the respective bipolar transistor which is the ratio of the collector current and the base current. Since these bipolar transistors have to conduct the base and the collector current of the bipolar transistor 72 during the conduction phase. In order to reduce the leakage current of the bipolar transistors 80, 82, a control transistor 102, 104 is respectively associated to the bipolar transistors 80, 82 in order to reduce the emitter base current as a leakage current. During the phase when one of the bipolar transistors 80, 82 is activated and the diodes 62, 64 are still blocking before the respective zero crossing and when the diode 62, 64 conducts after the zero crossing, the collector of the respective control transistor will drive the base of the respectively connected bipolar transistor 80, 82. Hence, the leakage current, i.e. the base emitter current of the second bipolar transistors 80, 82 can be reduced with low technical effort and the control transistors 102, 104 can also be integrated in an IC together with the bipolar transistor 80, 82. The control transistors 102, 104 are preferably low voltage bipolar junction transistors.

The polarity dependent bleeder 66 shown in FIG. 5 also comprises a third bleeding path 106 formed as a bipolar transistor 108 and a control unit 110 for connecting the first current control unit 72 to a second output terminal 70 in order to provide a further bleeding path. The third bleeding path 106 can also be integrated in an integrated circuit.

The third bleeding path 106 is optional and may be provided in any of the embodiments of the present invention.

It shall be understood that the control units 98, 100, 110 may be provided as a single control unit having different control output terminals and different input terminals and may also be integrated in the integrated circuit with the bipolar transistors 80, 82, 102, 104.

The driver device 50 is preferably used for light assemblies, but may be used for all low power electronic devices which are connected to a (legacy) leading edge dimmer device 14.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A driver device for driving a load, in particular an LED unit having one or more LEDs, comprising:

input terminals for receiving an input voltage from an external power source for powering the load, and a connection unit for connecting the input terminals to each other and for providing a current path for a bleeding current, wherein the connection unit comprises a first current path for connecting the input terminals in a first current direction and a second current path for connecting the input terminals in a second current direction opposite to the first current direction, wherein the connection unit comprises a first current control unit for controlling the bleeding current in the connection unit, and wherein the first and the second current path each comprises a second current control unit for controlling the bleeding current in the respective current path.

2. The driver device as claimed in claim 1, wherein the connection unit comprises a plurality of decoupling devices, wherein one decoupling device is associated to each of the current paths for blocking the bleeding current in the respective current path in a current direction opposite to the current direction for which the respective current path is provided.

3. The driver device as claimed in claim 1, wherein a control unit is provided for controlling the second current control units on the basis of a voltage potential detected at the respective current path.

4. The driver device as claimed in claim 1, wherein the first current control unit is connected in series to each of the current paths, wherein the current paths are connected in parallel to each other.

5. The driver device as claimed in claim 1, wherein the driver device comprises a rectifier unit for rectifying the input voltage and for providing a rectified voltage to the load for driving the load, wherein the first current control unit is connected to a first output node of the rectifier unit and the second current control units are each connected to two decoupling devices of the rectifier unit.

6. The driver device as claimed in claim 5, wherein decoupling devices are connected between the second current control units and a second output node of the rectifier unit and are adjusted in a reverse direction for blocking the bleeding current.

7. The driver device as claimed in claim 5, wherein two decoupling devices are each connected in series between the second output node and one of the input terminals.

8. The driver device as claimed in claim 5, wherein a third current path comprising a second current control unit is connected between the first current control unit and second output node of the rectifier unit.

9. The driver device as claimed in claim 1, wherein the first current control unit is provided for enabling and/or for controlling the bleeding current in the connection unit and the second current control units are controllable switches for enabling the bleeding current in the respective current path.

10. The driver device as claimed in claim 1, wherein the first current control unit and the second current control units are connected to each other such that the first current control unit is activated for enabling the bleeding current if one of the second current control units is activated and the polarity of the input voltage changes.

11. The driver device as claimed in claim 1, wherein the second current control units each comprises two controllable switches, wherein a first of the two controllable switches is adapted to conduct the bleeding current and is controlled by a second of the two controllable switches.

12. The driver device as claimed in claim 3, wherein the control unit is adapted to activate one of the second current control units during a first half cycle of the input voltage and to deactivate the respective current control unit during a following half cycle of the input voltage.

13. The driver device as claimed in 3, wherein the control unit is adapted to control the current control units on the basis of a phase angle of the input voltage detected by a phase angle detection device.

14. A driving method for driving a load, in particular an LED unit comprising one or more LEDs, the driving method comprising the steps of:

receiving an input voltage from an external power supply at input terminals, connecting the input terminals to each other by means of a connection unit providing a first current path for a bleeding current in a current direction from a first of the input terminals to a second of the input terminals and a second current path for the bleeding current in a current direction from the second to the first input terminal, controlling the bleeding current in the connection unit by means of a first current control unit, and controlling the bleeding current in each of the current paths by means of second current control units.

15. A light apparatus comprising:

a light assembly comprising one or more light units, in particular an LED unit comprising one or more LEDs, and the driver device for driving said light assembly as claimed in claim 13.

* * * * *